United States Patent [19]

Eblen et al.

[11] 4,403,740

[45] * Sep. 13, 1983

[54] FUEL INJECTION NOZZLE

[75] Inventors: Ewald Eblen, Stuttgart; Karl Hofmann, Neckarrems; Odon Kopse, Stuttgart, all of Fed. Rep. of Germany

[73] Assignee: Robert Bosch GmbH, Stuttgart, Fed. Rep. of Germany

[ * ] Notice: The portion of the term of this patent subsequent to Aug. 25, 1998, has been disclaimed.

[21] Appl. No.: 261,062

[22] Filed: May 6, 1981

Related U.S. Application Data

[62] Division of Ser. No. 886,323, Mar. 13, 1978, Pat. No. 4,285,471.

[30] Foreign Application Priority Data

Mar. 16, 1977 [DE] Fed. Rep. of Germany ..... 2711393

[51] Int. Cl.[3] ..... F02M 61/04

[52] U.S. Cl. ..... 239/553.2; 239/533.12; 239/533.1, 562, 563

[58] Field of Search ..... 239/533.2–533.12, 239/562, 563

[56] References Cited

U.S. PATENT DOCUMENTS

| | | | |
|---|---|---|---|
| 1,833,080 | 11/1931 | Kenworthy | 239/533.4 X |
| 1,834,061 | 12/1931 | Joachim | 239/533.4 X |
| 3,633,823 | 1/1972 | Steiger | 239/533.8 X |
| 3,797,753 | 3/1974 | Fenne et al. | 239/533.8 |
| 4,171,099 | 10/1979 | Kopse et al. | 239/533.8 |
| 4,285,471 | 8/1981 | Eblen et al. | 239/533.4 |

*Primary Examiner*—Andres Kashnikow
*Attorney, Agent, or Firm*—Edwin E. Greigg

[57] ABSTRACT

The invention relates to a fuel injection nozzle in which a control piston acts on the valve needle, which control piston can also be acted upon by another fluid with an arbitrarily changeable pressure. In this manner it is relatively simple to meet the ever increasing requirements to apply an influence of engine characteristic values to the fuel injection process.

12 Claims, 9 Drawing Figures

FUEL INJECTION NOZZLE

CROSS REFERENCE TO RELATED APPLICATIONS

This application is a divisional application of my application Ser. No. 886,323, filed Mar. 13, 1978 and now U.S. Pat. No. 4,285,471.

BACKGROUND OF THE INVENTION

The invention relates to a fuel injection nozzle for internal combustion engines provided with a valve needle which opens against a closing force and with a control piston that acts on the valve needle and is acted upon by a fluid, especially fuel of varying pressure. In a known fuel injection nozzle of this type, the control piston is acted upon by a pressure that is basically the same as the pressure of the fuel coming from the fuel injection pump into the pressure chamber of the fuel injection nozzle. The diameter of the adjusting piston must therefore be relatively small, in any case smaller than that of the valve needle, and in addition, there must be a very good seal between this control piston and the bore that contains the same because of the high pressure involved. If an influence is to then be taken from other engine characteristic values for this pressure, then this pressure must be relatively high if it is to have a corresponding effect. A higher pressure, however, requires a relatively expensive pressure producer, together with all of the disadvantages associated with this type of high pressure device, such as, for example, (1) the great effect of even minor leakage on the pressure, (2) especially good sealing devices which are also necessary for safety reasons, and not least significant, (3) a difficult regulation of this relatively high pressure in dependence on engine characteristic values. A further disadvantage of this pressure that changes synchronously with the injection pressure is that a major problem of synchronization exists because of fluctuations in the pressure at the individual engine nozzles caused by valves and other devices, such as throttles, lines and leakage, etc. In a different known fuel injection nozzle the fuel that flows between the valve needle and the nozzle body acts on the control piston, so that this pressure is continually regulated by means of a pressure control valve. As mentioned above, this fuel injection nozzle has the same disadvantages as the other.

OBJECT AND SUMMARY OF THE INVENTION

Theh fuel injection nozzle according to the present invention has the advantage that it can be directly and widely influenced by the engine characteristic values, and is in fact regulatable in accordance with such values. It is indeed already known to lead pressurized fuel into the spring chamber of the fuel injection nozzle, so that the pressure is controlled independently of the fuel injection pressure supplied to the fuel injection nozzle. The fuel thereby acts upon the valve needle from the spring side, so that the pressure must be adapted for its controlling effect to the diameter of the guided section of the valve needle. Aside from the fact that an unfavorable control pressure is required because of this diameter determination, the possibilities for engagement or responsive action are very limited. All that can be done is strengthen or weaken a force which acts on the valve needle in the same direction as the force of the spring. For a desirable range of control under such circumstances, the spring must be formed very weak, that is, so weak that when the control pressure fails the fuel injection device will no longer function properly. A further limiting disadvantage is that one is always required to use fuel in this known nozzle, because it is unavoidable. In some embodiments of the invention, on the other hand, a different medium such as air pressure, brake fluid or air conditioning hydraulic oil can serve as the servo fluid. In addition, in this known fuel injection nozzle without a control piston, a pressure stage can only be produced with the great expense of a second spring, and this type of pressure stage is becoming increasingly unavoidable for a favorable spreading of the fuel.

Another advantage of this invention is that the control fluid pressure can be changed by means of a pressure control valve in dependence on engine characteristic values.

Still another advantage of this invention is that the nozzle structure includes an axially disposed spindle-type valve needle which is telescoped by a hollow valve needle and by means of separate pressure chambers, first the hollow needle is caused to be moved so that injection can begin and thereafter pressure from the second chamber can bring about movement of the spindle-type valve needle.

The invention will be better understood as well as further objects and advantages thereof becomes more apparent from the ensuing detailed description of several preferred embodiments taken in conjunction with the drawings.

DESCRIPTION OF THE PREFERRED EMBODIMENTS

Figure 1:
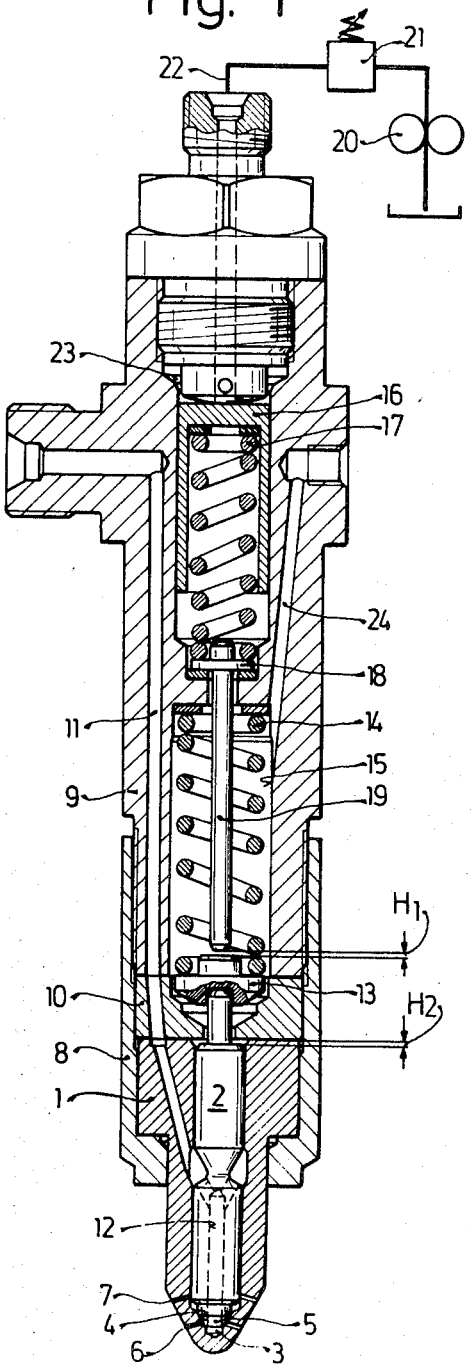
FIG. 1 shows a fuel injection nozzle in a longitudinal cross-sectional view with a control piston being influenced by a pressure that is controllable in dependence on engine characteristic values.

Turning now to the drawings of the structure shown in the exemplary embodiment of FIG. 1, a valve needle 2 is radially sealed and axially movable in a nozzle body 1. The valve needle 2 and the nozzle body 1 define a pressure chamber 3. A conical valve seat 4 is provided within the nozzle body 1 with the conical valve seat 4 arranged to cooperate with a sealing cone 5 disposed on the valve needle 2. During the initial movement of the valve needle 2 away from the valve seat 4 the injection ports 6 which are correlated with the valve seat 4, as shown, are opened and the continued stroke movement of the valve needle 2 then reveals the injection ports noted as 7. Thus, by the valve needle 2 being lifted from the valve seat 4, the surface area of the needle which is influenced by the fuel that acts in the direction of opening is substantially enlarged.

The nozzle body 1 is held against a nozzle holder 9 by cap screw 8. An intermediate plate 10 is arranged between the nozzle body 1 and the nozzle holder 9. A pressure line 11 for the fuel supplied under pressure from the fuel injection pump, not shown, extends through the nozzle holder 9, the intermediate plate 10 and the nozzle body 1. In this first exemplary embodiment of the invention, the pressure line 11 is connected with the pressure chamber 3 by a connecting channel 12 that is arranged in the valve needle 2. The valve needle 2 is loaded by a closing spring 14 that is arranged in a chamber 15 provided in the nozzle holder 9 with the lower end of the spring 14 being supported on a plate element 13 positioned above the valve needle 2.

An axially guided radially sealed control piston 16 the axial position of which acts directly on the tension force of a spring 17 is arranged in the nozzle holder 9. In this first exemplary embodiment, the control piston 16 is loaded by one end of the spring 17 while the other end thereof is supported against a flanged element 18 provided at the end of a stop 19. The opposite side of the control piston 16 is acted upon by fuel pressure that is controllable in dependence on engine characteristic values. This fuel is fed through a supply pump 20 and a subsequent pressure control valve 21 and a line 22 into a chamber 23 provided above the control piston 16. In this first exemplary embodiment of the invention the spring chamber 15 is relieved of pressure by means of a leakage channel 24, as shown.

Figure 2:
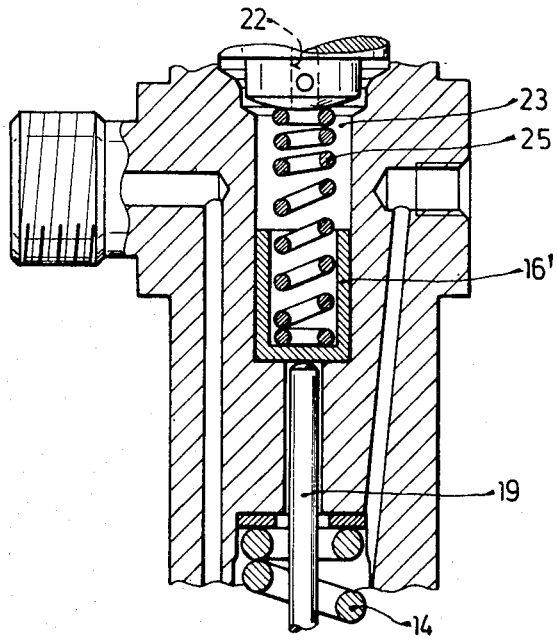
FIG. 2 is another embodiment of the invention shown in a fragmentary cross-sectional view.

In the second exemplary embodiment of this invention shown in the fragmentary view of FIG. 2, a control spring 25 is arranged to act on the control piston 16' on the side opposite to the valve needle 2. The control spring 25 thus acts in the direction of the closing spring 14. The controlled pressure that is supplied into the chamber 23 through the control line 22 thus acts upon the control piston 16' on the side that is influenced by the spring 25. The control spring 25 and the regulated pressure thus operate in the same direction. In this manner the diameter of the control piston 16 can be held substantially smaller than in the first exemplary embodiment described hereinbefore. The elongated stop element 19 is thus arranged between the spring plate of the closing spring 14 and the control piston 16' and can be effectively connected with the piston.

Figure 2A:
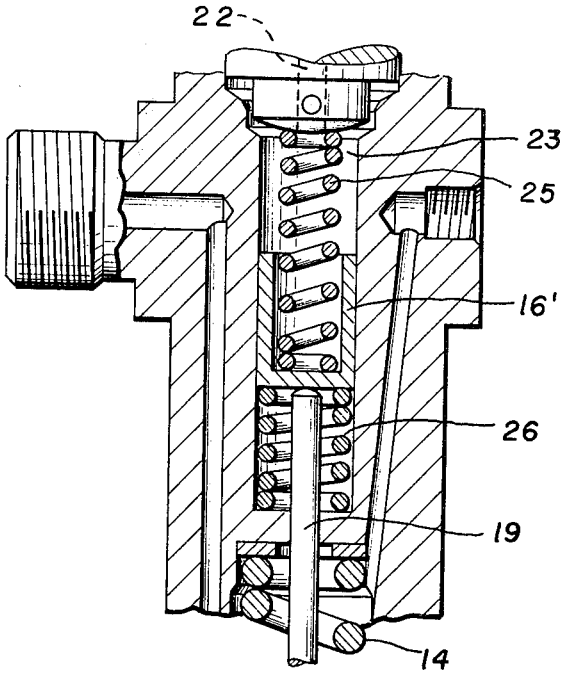
FIG. 2*a* is a view similar to FIG. 2 of a modification of the embodiment of FIG. 2.

In FIG. 2*a*, the chamber 23 is elongated and compensating spring 26 is adapted to serve as a variation of the exemplary embodiment of FIG. 2 to compensate for the mass of the control piston 16'.

It is, however, also conceivable that this additional spring 26 can serve not only to compensate for the mass, but additionally can function as a coupling spring for the control spring 25 and represents an additional spring force variation. Of course, it is also conceivable that the control piston 16' can be loaded by a means other than a spring, e.g., by the regulation of the control pressure applied to the piston on the side opposite to the valve needle 2. In both the first and second exemplary embodiments of this invention, there is a certain distance provided for between the elongated stop 19 and the spring supporting plate 13 when the fuel injection nozzle is closed, as shown.

Figure 3:
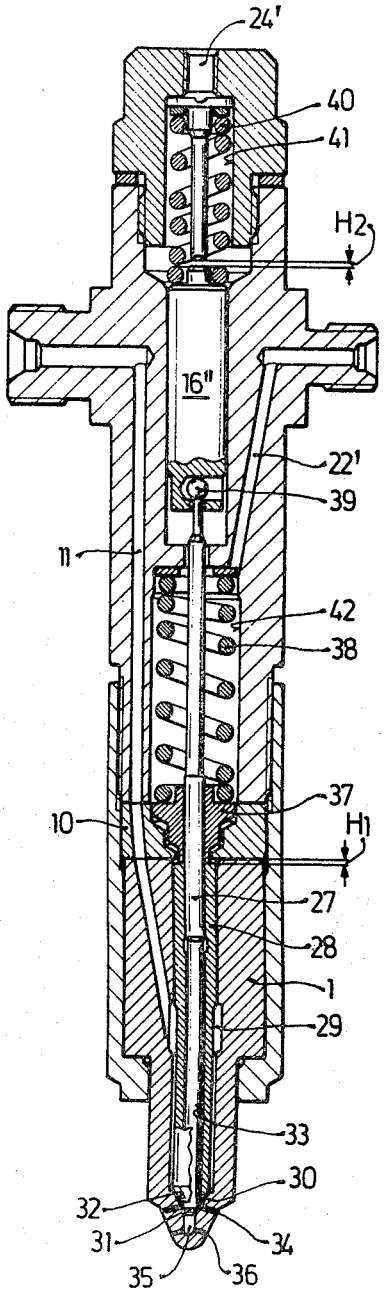
FIG. 3 is another embodiment of the invention shown in a longitudinal cross-sectional view.

In the third exemplary embodiment of this invention, as shown in FIG. 3, the valve needle 27 comprises a slender valve needle which is radially sealed and axially movable in a hollow valve needle 28. The hollow valve needle 28, which it will be noted telescopes the slender valve needle 27, is likewise axially movable and radially sealed in the nozzle body 1. The pressure line 11 leads directly into a pressure chamber 29 that is provided between the hollow needle 28 and the nozzle body 1. The valve needle 27 and the hollow valve needle 28 each have a conical sealing area 30,31 which cooperate with a valve seat 32 provided in the nozzle body 1. An intermediate chamber 33 having plural stages is provided between the valve needle 27 and the hollow needle 28 as a pressure chamber for the valve needle 27. The hollow needle 28 controls one or more injection openings 34 while the valve needle 27 controls the access to a blind bore 35 as well as one or more injection openings 36.

The hollow needle 28 is loaded by a closing spring 38 the lower end of which is supported on the flanged element 37. The valve needle 27, on the other hand, is coupled to the control piston 16" by means of a spherical head 39 so as to be form-fitting in an axial direction. A closing spring 40 influences the control piston 16" and therethrough acts on the valve needle 27. The chamber 41 that encloses the spring 40 is relieved of pressure by means of a leakage channel 24'. The chamber 42 that encloses the spring 38, on the other hand, is connected with a source of the regulated pressure by a channel 22'. This regulated pressure thus acts against the closing direction on the control piston 16" and in the closing direction on the valve needle 27 and the hollow needle 28.

Figure 4:
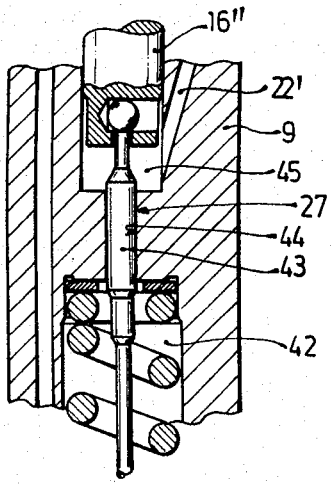
FIG. 4 is still another embodiment of the invention shown in a fragmentary cross-sectional view.

In the fourth exemplary embodiment of the invention, as shown in the fragmentary view of FIG. 4, in contrast to the previous example, a section 43 of the valve needle 27 is guided in a bore 44 of the nozzle holder 9 in such a manner that it is axially movable and radially sealed. In this way, a chamber 45 is hydraulically separated from the spring chamber 42. The chamber 45 is connected with the control pressure line 22' so that the regulated control pressure prevails therein. The spring chamber 42 is connected with the spring chamber 41 by a channel that is not shown, and thus is relieved of pressure. In this manner, the regulated pressure acts only on the control piston 16" and on the valve needle 27 with regard to the cross section of the guided section 43. The hollow needle 28, on the other hand, is not influenced in the closing direction by regulated fuel.

Figure 5:
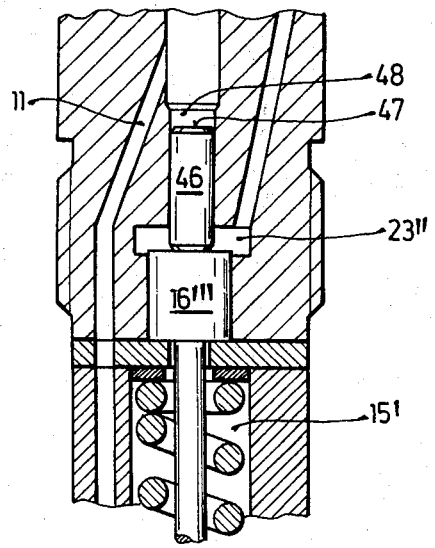
FIG. 5 is yet another embodiment of the invention shown in a fragmentary cross-sectional view.

In the fifth exemplary embodiment of the invention, as fragmentarily shown in FIG. 5, an adjusting piston 46 acts on the control piston 16''' while the other side 47 of the adjusting piston 46 is acted upon by the fuel that is supplied through injection under pressure. The frontal side 47 emerges into a chamber 48 which is directly connected with the pressure line 11. The regulated control pressure can then either be let into the chamber 23" above the control piston 16''' or into the spring chamber 15'. One of the two chambers, then, is relieved of pressure.

Figure 6:
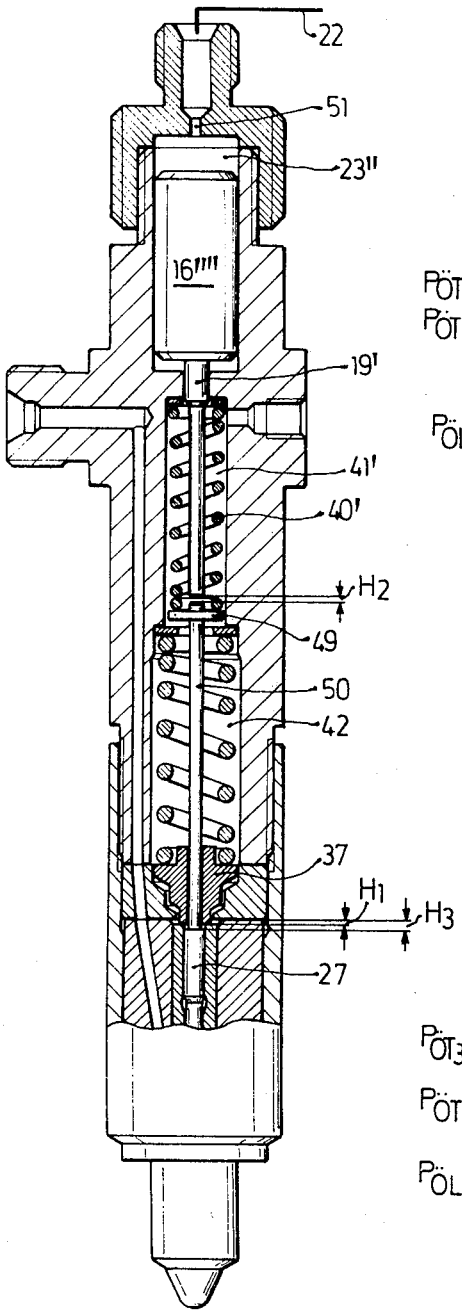
FIG. 6 is a further embodiment of the invention showing the nozzle in a longitudinal cross-sectional view.

In the sixth exemplary embodiment of the invention, as shown in the longitudinal cross sectional view of FIG. 6, the closing spring 40' directly loads the valve needle 27 by means of a flanged plate 49 and its supporting rod 50. A spring chamber 41' which surrounds the closing spring 40' is relieved of pressure in the same manner as the spring chamber 42. The control piston 16'''' acts on the valve needle 27 by means of a rod element 19' which also serves as a stop. The control piston 16'''' is acted upon on the side opposite the rod 19' by the regulated fuel that is fed into the chamber 23''. A throttle 51 is arranged in the fuel line, as shown at 22, by means of which the control characteristic of the nozzle can be additionally influenced. This throttle 51 causes a damping of the movement of the control piston 16'''' as well as that of the valve needle 27 which thus results in a temporary increase of the injection pressure. The hollow needle 28, as in the examples in FIGS. 3 and 4, has a maximum stroke of $H_1$. The valve needle 27, on the other hand, has a stroke $H_2$ until it strikes the stop 19'. After the force of the control piston 16'''' has been overcome, the maximum stroke of the valve needle 27 increases to $H_3$. After this stroke, it strikes the spring supporting element 37 of the hollow needle 28. According to the teaching of this invention however, the piston 16'''' can act continuously on the valve needle 27, so that the stroke $H_2$ can be eliminated together with the pressure stage attained thereby.

OPERATION OF THE RESPECTIVE EMBODIMENTS OF THE INVENTION

When the fuel supplied from the fuel injection pump in the first exemplary embodiment shown in FIG. 1 has attained a sufficient pressure in the pressure chamber 3, the valve needle 2 is pushed against the closing spring 14 up to the stop 19. The valve needle 2 thus travels over what is denoted as a first stroke $H_1$. During this first stroke only the injection openings 6 are opened. This first stroke corresponds to idle running of an internal combustion engine and the lower partial load ranges. Not until the fuel supplied from the pump further increases and the associated pressure further increases is the valve needle 2 together with the stop 19 pushed against the spring 14 and also now against the spring 17. After a predetermined stroke has been completed at least one injection opening 7 is opened by the sliding movement of the valve needle 2. In this manner the total opening cross section is enlarged to such an extent, that the necessary fuel quantity, which corresponds to the higher partial load range or full load, is available when needed, together with a corresponding atomization of the fuel. The respective total cross sections of the injection openings 6 and 7 are adapted to the fuel quantities necessary for idling and lower partial loads as well as high partial load and full load. The valve needle 2 strikes the intermediate plate 10 after completion of its maximum stroke $H_2$. It is conceivable, however, that during the stroke axial successive injection openings could be opened. By changing the pressure acting on the control piston 16, the tension of the adjusting spring 17 is altered and the pressure stage of the valve needle 2 is accordingly changed, i.e. the pressure at which the supplied fuel pushes the valve needle to open the injection openings 7. Thus, for example, it is desirable that the opening pressure, when the engine is cold, is different from the time when the engine is warm or that the opening pressure is changed during rpm changes to change the poisonous proportions in the exhaust gas emitted by the internal combustion engine. A further possibility exists for the changing of the opening pressure to obtain an improvement in the noise of the internal combustion engine. This change, however, is mostly dependent on the rpm and not only on the load. Thus, it can be that during full load and low rpm, for which the valve needle 2 has already completed the aforesaid stages, a lower pressure is necessary than at a higher rpm and a relatively low load.

Figure 7:
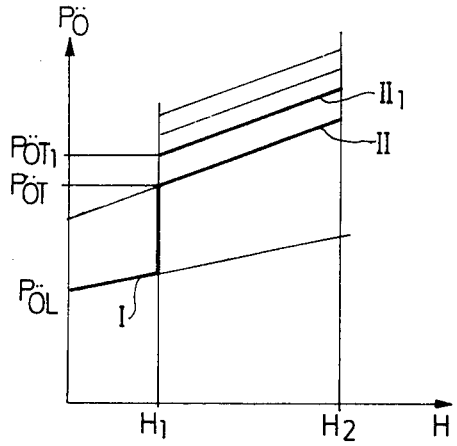
FIGS. 7 and 8 are graphic displays of the operation of the respective concepts.

The pressure function of this first exemplary embodiment can be seen from the diagram shown in FIG. 7. In this diagram the pressure $P_O''$ of the supplied fuel is shown in the ordinate and the stroke H of the valve needle is shown in the abscissa. When the idling pressure $P_{OL}''$ is attained, the valve needle begins to lift away from the valve seat, shown here as characteristic curve I (ideally actually somewhat higher, the illustration corresponds to the closing pressure). After the stroke $H_1$ has been completed it strikes the stop, so that a further movement of the valve needle cannot take place until the pressure $P_{OT}''$ is reached, which corresponds to the partial load. Then the valve needle is pushed farther until the stroke $H_2$ is completed, and at this time it opens the injection openings 7. This farther travel of the valve needle 2 is designated as characteristic curve II. The higher is the pressure of the regulating fluid the higher is the opening pressure $P_{OT}''$, so that the characteristic curve II is moved parallel, such as for example, as characteristic curve $II_1$ at the pressure $P_{OT1}''$ etc. At the opening pressure (from idling $P_{OL}''$ to full load) nothing changes.

The exemplary embodiment shown in FIG. 2 operates in principle in the manner of that previously described. Instead, however, of operating on the stop by means of a spring, the control piston 16' acts directly on the stop 19, that is, it is part of the stop. The control spring 25 in this way replaces the control fluid, thus in matching the pressure of the spring, the control piston 16' can be kept relatively small in diameter. By means of the compensating spring 26, which is shown in FIG. 2A, the mass of the control piston 16' can be compensated for and spring couples can be selected in combination with the control spring 25 that are desirable for proper regulation. In this manner a wider group of variation possibilities is given. Basically, this applies as well to the control diagram shown in FIG. 7.

Figure 8:
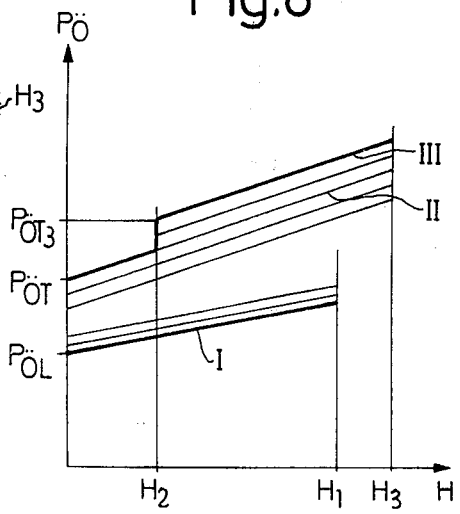

In the third exemplary embodiment shown in FIG. 3, first the hollow needle 28 and then the valve needle 27 is shifted by the supplied fuel. This embodiment corresponds to the diagram shown in FIG. 8. When the pressure $P_{OL}''$, which is sufficient for the hollow needle 28 and is approximately 300 bar, the hollow needle 28 is lifted away from its valve seat 32 and the injection openings 34 for the idling or the lower partial load are thus opened. The hollow needle 28 is pushed against the intermediate plate 10 after the completion of a strike $H_1$. At greater supply quantities, when the pressure $P_{OT}''$ is reached, the valve needle 27 is lifted away from valve seat 34 and opens the injection openings 36 as an injection cross section enlargement. After completion of the stroke $H_2$ against the force of the closing spring 40, the valve needle 27 then strikes a stop arranged to cooperate therewith. In FIG. 8 the characteristic curve of the hollow needle 28 is designated with I, that of the valve needle 27 with II. By changing the control pressure in the spring chamber 42 the opening pressure $P_{OL}''$ is changed, so that the characteristic curve I is shifted nearly parallel. This can be desirable for the previously mentioned reasons, and is not possible, for example, in the first exemplary embodiment. This changed control pressure in the spring chamber 42 acts oppositely, however on the opening pressure of the valve needle 27. Thus, an increase of the control pressure causes a decrease of the valve opening pressure of the needle 27. In this manner the characteristic curve II is pushed indeed parallel, but downward. After a predetermined control pressure, then the opening pressure of the hollow needle 28 is approximately the same as the opening pressure of the valve needle 27. For normal operation of the fuel injection nozzle, however, it is necessary that the opening pressure of the hollow needle 28 be always somewhat lower than that of the valve needle, in order to assure at the end of the injection, that first the valve needle 27 closes, and then the hollow needle 28 will also close. It may however be also desirable that the valve needle 27 does not close again, that is open to begin with. This is the case when the valve needle 27 is moved from its seat by the control piston 16".

Because the valve needle section 43 is guided in a sealed manner, as in the fourth exemplary embodiment shown in FIG. 4, a change of the $P_{OT}''$, that is, a parallel shifting of the characteristic curve II can take place, without the opening pressure $P_{OL}''$ of the hollow needle 28 changing, thus there occurs no parallel shifting of the characteristic curve I.

The fifth exemplary embodiment shown in FIG. 5, in addition to the one previously described, has only an additional adjusting piston 46, whose force is determined by the injection pressure. Because this injection pressure, however, changes during the injection, this piston 46 operates as an automatic closing force, which in the diagrams in FIGS. 7 and 8 would have as a result a corresponding change of the slope of the characteristic curves, which aside from an unloading of the closing spring also offers additional possibilities to supplement the characteristic field.

The exemplary embodiment shown in FIG. 6 is functionally a combination of the exemplary embodiments shown in the FIGS. 1 and 2 with those in FIGS. 3 and 4. Accordingly, after the stroke $H_2$, during which the valve needle 27 comes into contact with the stop, an additional pressure stage up to pressure $P_{OT3}''$ is reached for the valve needle 27. This means a parallel shifting of the characteristic curve II upward after the stroke $H_2$, designated here as characteristic curve III. In this embodiment the first stroke of the valve needle 27 corresponds to the characteristic curve II and the following stroke $H_3$ corresponds to the parallel shifted characteristic curve III.

Of course, other variations of the characteristics of the scope of the invention are also covered by the individual embodiments shown here.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection nozzle for internal combustion engines comprising, in combination, a nozzle body having a first set of fuel injection openings and fuel inlet means for applying pressurized fuel to said first set of injection openings, a slidable valve needle in said nozzle body, means for applying a closing force to said valve needle against which said valve needle opens for moving said valve needle into closing relationship with said first set of injection openings, a control piston slidably disposed in said nozzle body for acting at one side on said valve needle, a spring in said nozzle body for loading said control piston in a closing direction of said valve needle, inlet means in said nozzle body for applying a pressurized control fluid from an associated source of fluid pressure to said control piston and means for controlling said control fluid pressure independently of the pressure of said pressurized fuel supplied from said fuel inlet means to said first set of injection openings.

2. A fuel injection nozzle according to claim 1 wherein said valve needle is arranged to act on said control piston after the completion of an idling opening stroke.

3. A fuel injection nozzle according to claim 1 including a pressure control valve responsive to engine characteristic values for changing said means for controlling said control fluid pressure.

4. A fuel injection nozzle according to claim 1 wherein said control piston is acted upon by said control fluid pressure on the other side opposite said valve needle.

5. A fuel injection nozzle according to claim 1 wherein said spring at least compensates for the mass of said control piston and also influences said control piston in the opening direction of said valve needle.

6. A fuel injection nozzle according to claim 1 including an intermediate spring for loading said control piston in the opening direction of said valve needle.

7. A fuel injection nozzle according to claim 6 including a spring plate in said nozzle body serving as a stop for said valve needle and wherein said intermediate spring is arranged between said control piston and said spring plate.

8. A fuel injection nozzle according to claim 7 including a mandrel on said spring plate, a closing spring for said valve needle in said nozzle body, said mandrel being arranged in coaxial relationship with said closing spring in engagement with said spring plate.

9. A fuel injection nozzle according to claim 1 including a second set of injection openings in said nozzle body and a further needle slidably mounted in said nozzle body for controlling said second set of injection openings.

10. A fuel injection nozzle according to claim 9 wherein said further needle comprises a hollow valve needle and wherein said valve needle is disposed within said hollow valve needle.

11. A fuel injection nozzle according to claim 9 including a pressure chamber in said nozzle body for said valve needle, a pressure chamber in said nozzle body for said further valve needle and wherein said fuel inlet means is arranged to conduct pressurized fuel first to said pressure chamber of said further needle and after a movement of said further needle to said pressure chamber of said valve needle.

12. A fuel injection nozzle according to claim 1 including a separate spring in said nozzle body for loading a further needle in closing relationship with a second set of injection openings.

* * * * *